US007434556B2

(12) United States Patent
Harmon

(10) Patent No.: US 7,434,556 B2
(45) **Date of Patent: *Oct. 14, 2008**

(54) ENGINE VALVE ACTUATION SYSTEM

(75) Inventor: Michael Patrick Harmon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/297,473

(22) Filed: Dec. 9, 2005

(65) Prior Publication Data

US 2006/0086330 A1 Apr. 27, 2006

Related U.S. Application Data

(63) Continuation of application No. 10/697,107, filed on Oct. 31, 2003, now Pat. No. 7,007,650.

(51) Int. Cl.
*F01L 1/18* (2006.01)

(52) U.S. Cl. ..... 123/90.44; 123/90.12; 123/90.39; 123/90.16; 74/569

(58) Field of Classification Search ..... 123/90.12, 123/90.13, 90.27, 90.31, 90.6, 90.39, 90.4, 123/90.41, 90.44, 90.15, 90.16; 74/559, 74/567, 569

See application file for complete search history.

(56) References Cited

U.S. PATENT DOCUMENTS 3,250,068 A 5/1966 Vulliamy (Continued)

FOREIGN PATENT DOCUMENTS

| | | | |
|---|---|---|---|
| JP | 05106415 | A2 | 4/1993 |
| JP | 2000120457 | A | 4/2000 |
| JP | 2000145484 | A | 5/2000 |
| WO | WO 98/02653 | | 1/1998 |

OTHER PUBLICATIONS

Edwards et al., "The Potential of a Combined Miller Cycle and Internal EGR Engine for Future Heavy Duty Truck Applications," The Engineering Society for Advancing Mobility Land Sea Air and Space International, International Congress and Exposition, Feb. 23-26, 1998, pp. 1-19.

(Continued)

*Primary Examiner*—Ching Chang
(74) *Attorney, Agent, or Firm*—Finnegan, Henderson, Farabow, Garrett & Dunner

(57) ABSTRACT

A valve actuation system is provided. The system has an engine valve moveable between a first position at which the engine valve prevents a flow of fluid relative to the engine valve and a second position at which fluid flows relative to the engine valve. The system also has a first cam adapted to move the engine valve from the first position to the second position during a first lift period in response to a rotation of the first cam. The system has a second cam adapted to move the engine valve from the first position to the second position during a second lift period in response to a rotation of the second cam. The system also has a cam following assembly disposed between the first and second cams and the engine valve. The cam following assembly is adapted to selectively connect one of the first and second cams with the engine valve to thereby move the engine valve through one of the first and second lift periods.

22 Claims, 6 Drawing Sheets

U.S. PATENT DOCUMENTS

| | | | | |
|---|---|---|---|---|
| 3,777,729 | A | | 12/1973 | Cote |
| 3,897,760 | A | | 8/1975 | Hisserich |
| 4,084,557 | A | | 4/1978 | Luria |
| 4,397,270 | A | | 8/1983 | Aoyama |
| 4,424,790 | A | | 1/1984 | Curtil |
| 4,530,318 | A | | 7/1985 | Semple |
| 4,561,253 | A | | 12/1985 | Curtil |
| 4,620,510 | A | | 11/1986 | Feuling |
| 4,708,101 | A | | 11/1987 | Hara et al. |
| 4,714,057 | A | * | 12/1987 | Wichart ..... 123/90.15 |
| 4,724,822 | A | | 2/1988 | Bonvallet |
| 4,815,423 | A | | 3/1989 | Holmer |
| 5,025,761 | A | | 6/1991 | Chen |
| 5,181,485 | A | | 1/1993 | Hirose et al. |
| 5,186,128 | A | | 2/1993 | Murata et al. |
| 5,289,806 | A | | 3/1994 | Hurr |
| 5,408,979 | A | | 4/1995 | Backlund et al. |
| 5,417,186 | A | | 5/1995 | Elrod et al. |
| 5,445,128 | A | | 8/1995 | Letang et al. |
| 5,682,854 | A | | 11/1997 | Ozawa |
| 5,685,264 | A | | 11/1997 | Allen et al. |
| 5,829,397 | A | | 11/1998 | Vorih et al. |
| 5,855,190 | A | | 1/1999 | Matsunaga |
| 5,927,075 | A | | 7/1999 | Khair |
| 5,950,582 | A | | 9/1999 | Stein |
| 6,026,786 | A | | 2/2000 | Groff et al. |
| 6,035,818 | A | | 3/2000 | Sato |
| 6,082,328 | A | | 7/2000 | Meistrick et al. |
| 6,170,441 | B1 | | 1/2001 | Haldeman et al. |
| 6,209,516 | B1 | | 4/2001 | Yamashita |
| 6,237,551 | B1 | | 5/2001 | Macor et al. |
| 6,267,107 | B1 | | 7/2001 | Ward |
| 6,273,076 | B1 | | 8/2001 | Beck et al. |
| 6,279,550 | B1 | | 8/2001 | Bryant |
| 6,301,887 | B1 | | 10/2001 | Gorel et al. |
| 6,301,889 | B1 | | 10/2001 | Gladden et al. |
| 6,302,076 | B1 | | 10/2001 | Bredy |
| 6,467,452 | B1 | | 10/2002 | Duffy et al. |
| 6,484,681 | B2 | | 11/2002 | Kuroda |
| 6,536,390 | B2 | | 3/2003 | Takahashi et al. |
| 6,571,765 | B2 | | 6/2003 | Kuboshima et al. |
| 6,595,170 | B2 | | 7/2003 | Wiekmeijer |
| 6,651,618 | B1 | | 11/2003 | Coleman et al. |
| 6,679,207 | B1 | | 1/2004 | Leman |
| 6,688,280 | B2 | | 2/2004 | Weber |
| 7,007,650 | B2 | * | 3/2006 | Harmon ..... 123/90.44 |

OTHER PUBLICATIONS

Obert, "Internal Combustion Engines and Air Pollution," Based on Internal Combustion Engines, Third Edition, 1973, pp. 612-614.

Challen et al., "Diesel Engine Reference Book, Section Edition," SAE International, 1999, pp. 75, 81, 84, 146, and 263-305.

Yorihiro Fukuzawa et al., "Development of High Efficiency Miller Cycle Gas Engine", Mitsubishi Heavy Industries, Ltd., Technical Review, vol. 38, No. 3, Oct. 2001, pp. 146-150.

Request for *Inter Partes* Reexamination Transmittal Form for US Patent 6,688,280, and Attachment to Request for *Inter Partes* Reexamination Transmittal Form, Sep. 17, 2004.

Request for *Inter Partes* Reexamination Transmittal Form for US Patent 6,651,618, and Attachment to Request for *Inter Partes* Reexamination Form, Aug. 27, 2004.

http://www.mazda.com.au/corpora/209.html, Oct. 16, 2001, p. 1-6.

* cited by examiner

ENGINE VALVE ACTUATION SYSTEM

CROSS REFERENCE TO RELATED APPLICATION

This application is a continuation of U.S. patent application Ser. No. 10/697,107 now U.S. Pat. No. 7,007,650, filed Oct. 31, 2003, which is incorporated herein by reference.

TECHNICAL FIELD

The present invention is directed to a system and method for actuating an engine valve and, more particularly, to a variable engine valve actuation system.

BACKGROUND

The operation of an internal combustion engine such as, for example, a diesel, gasoline, or natural gas engine, may cause the generation of undesirable emissions. These emissions, which may include particulates and oxides of nitrogen (NOx), are generated when fuel is combusted in a combustion chamber of the engine. An exhaust stroke of the engine piston forces exhaust gas, which may include these emissions, from the engine. If no emission reduction measures are in place, these undesirable emissions will eventually be exhausted to the environment.

Research is currently being directed towards decreasing the amount of undesirable emissions that are exhausted to the environment during the operation of the engine. It is expected that improved engine design and improved control over engine operation may lead to a reduction in the generation of undesirable emissions. Many different approaches such as, for example, exhaust gas recirculation, water injection, fuel injection timing, and fuel formulations, have been found to reduce the amount of emissions generated during the operation of the engine. Aftertreatments such as, for example, traps and catalysts, have been found to effectively remove emissions from an exhaust flow. Unfortunately, the implementation of these emission reduction approaches typically results in a decrease in the overall efficiency of the engine.

Additional efforts are being focused on improving engine efficiency to compensate for the efficiency loss due to the emission reduction systems. One such approach to improving the engine efficiency involves adjusting the actuation timing of the engine valves. For example, the actuation timing of the intake and exhaust valves may be modified to implement a variation on the typical diesel or Otto cycle, such as the Miller cycle. In a "late intake" type Miller cycle, the intake valves of the engine are held open during a portion of the compression stroke of the piston. Selective implementation of a variation on the conventional actuation timing such as the Miller cycle, may lead to an improvement in the overall efficiency of the engine.

The engine valves in an internal combustion engine are typically driven by a cam arrangement that is operatively connected to the crankshaft of the engine. The rotation of the crankshaft results in a corresponding rotation of a cam that drives one or more cam followers. The movement of the cam followers results in the actuation of the engine valves. The shape of the cam governs the timing and duration of the valve actuation. As described in U.S. Pat. No. 6,237,551 to Macor et al., issued on May 29, 2001, a "late intake" Miller cycle may be implemented in such a cam arrangement by modifying the shape of the cam to overlap the actuation of the intake valve with the start of the compression stroke of the piston.

However, while valve actuation timing adjustments may provide efficiency benefits, these actuation timing adjustments may also result in detrimental engine performance under certain operating conditions. For example, a late intake Miller cycle may be inefficient when the engine is starting, operating under cold conditions, or experiencing a transient condition such as a sudden increase in engine load. This detrimental engine performance is caused by a decrease in the mass of air flowing through the engine. Especially under cold ambient conditions, the delayed start of compression may lead to cylinder temperatures insufficient to support good combustion and startability.

Thus, to obtain the greatest gains from implementing a variation on conventional valve actuation timing, the engine requires a variable valve actuation system. As noted above, the shape of the driving cam determines the actuation timing of a valve system driven by a cam arrangement. Because the shape of the cam is, fixed, this type of arrangement is inflexible and may only be changed during the operation of the engine through the use of complex mechanical mechanisms.

The engine valve actuation system and method of the present invention solves one or more of the problems set forth above.

SUMMARY OF THE INVENTION

In one aspect, the present invention is directed to a valve actuation system. The system includes an engine valve moveable between a first position at which the engine valve prevents a flow of fluid relative to the engine valve and a second position at which the fluid flows relative to the engine valve. The system also includes a first cam adapted to move the engine valve from the first position to the second position during a first lift period in response to a rotation of the first cam. The system further includes a second cam adapted to move the engine valve from the first position to the second position during a second lift period in response to a rotation of the second cam. The system also includes a cam following assembly disposed between the first and second cams and the engine valve. The cam following assembly is adapted to selectively connect one of the first and second cams with the engine valve to thereby move the engine valve through one of the first and second lift periods.

In another aspect, the present invention is directed to a method of actuating an engine valve having a first position at which the engine valve prevents a flow of fluid relative to the engine valve and a second position at which the fluid flows relative to the engine valve. The method includes rotating a first cam having an outer surface adapted to move the engine valve between the first position and the second position during a first lift period. The method also includes rotating a second cam having an outer surface adapted to move the engine valve between the first position and the second position during a second lift period. The method further includes operating a cam following assembly to selectively connect one of the first and second cams with the engine valve to thereby move the engine valve through one of the first and second lift periods.

DETAILED DESCRIPTION

Figure 1:
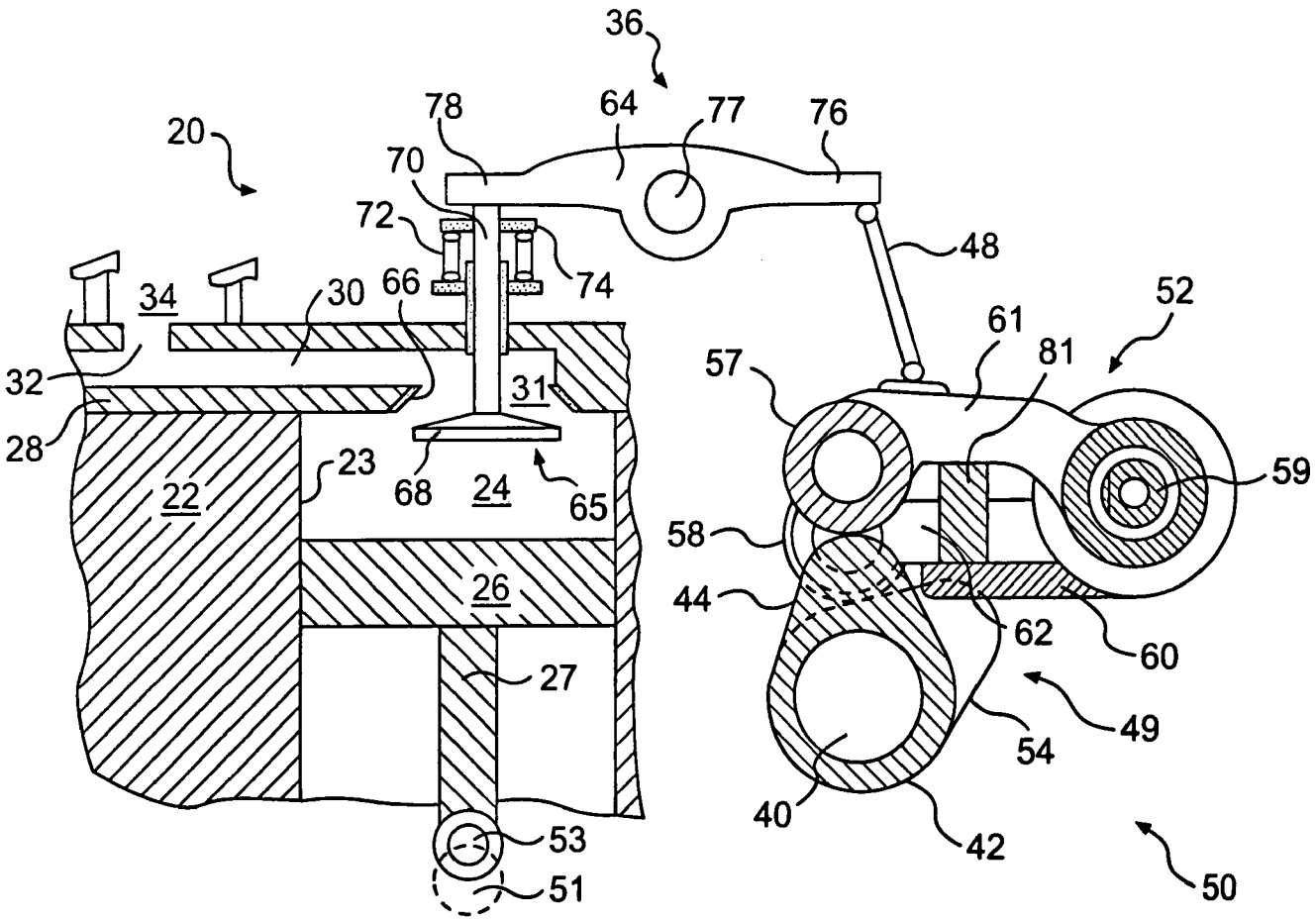
FIG. 1 is a schematic and diagrammatic cross sectional illustration of an engine valve actuation system in accordance with an exemplary embodiment of the present invention.

An exemplary embodiment of an engine 20 is schematically and diagrammatically illustrated in FIG. 1. Engine 20 includes an engine block 22 that defines a plurality of cylinders 23 (one of which is illustrated in FIG. 1). A piston 26 is slidably disposed within cylinder 23 to reciprocate between a top-dead-center position and a bottom-dead-center position.

For the purposes of the present disclosure, engine 20 is described as a four-stroke diesel engine. One skilled in the art will recognize, however, that engine 20 may be any other type of internal combustion engine such as, for example, a gasoline or natural gas engine.

A connecting rod 27 connects piston 26 to an eccentric crankpin 53 of a crankshaft 51. Piston 26 is coupled to crankshaft 51 so that a movement of piston 26 between the top-dead-center position and the bottom-dead-center position results in a rotation of crankshaft 51. Similarly, a rotation of crankshaft 51 will result in a movement of piston 26 between the top-dead-center position and the bottom-dead-center position. In a four-stroke diesel engine, piston 26 will reciprocate between the top-dead-center position and the bottom-dead-center position through an intake stroke, a compression stroke, a combustion stroke, and an exhaust stroke.

Engine 20 also includes a cylinder head 28. Cylinder head 28 is engaged with engine block 22 to cover cylinder 23 and define a combustion chamber 24. Cylinder head 28 defines an intake passageway 30 that leads from an intake manifold opening 32 in an intake manifold 34 to an intake opening 31 into combustion chamber 24. Intake gases may be directed from intake manifold 34 through intake passageway 30 to combustion chamber 24.

Cylinder head 28 may also define an exhaust passageway (not shown) that leads from combustion chamber 24 to an exhaust manifold (not shown). Exhaust gases from combustion chamber 24 may be directed through the exhaust passageway to the exhaust manifold. These exhaust gases may then be directed from engine 20 and exhausted to the environment.

An intake valve 65 having an intake valve element 68 may be disposed in intake opening 31. Intake valve element 68 is configured to selectively engage a seat 66 in intake opening 31. Intake valve element 68 may be moved between a first position where intake valve element 68 engages seat 66 to prevent a flow of fluid relative to intake opening 31 and a second position (as illustrated in FIG. 1) where intake valve element 68 is removed from seat 66 to allow a flow of fluid relative to intake opening 31.

A series of valve actuation assemblies 36 (one of which is illustrated in FIG. 1) may be operatively engaged with engine 20. One valve actuation assembly 36 may be provided to move intake valve element 68 between the first and second positions. Another valve actuation assembly 36 may be provided to move an exhaust valve element (not shown) between the first and second positions.

It should be noted that each cylinder 23 might include multiple intake openings 31 and exhaust openings (not shown). Each such opening will have an associated intake valve element 68 or exhaust valve element (not shown). Engine 20 may include two valve actuation assemblies 36 for each cylinder 23. The first valve actuation assembly 36 may be configured to actuate each of the intake valve elements 68 for each cylinder 23, and the second valve actuation assembly 36 may be configured to actuate each of the exhaust valve elements. Alternatively, engine 20 may include a separate valve actuation assembly to actuate each intake valve element 68 and each exhaust valve element.

Each valve actuation assembly 36 includes a rocker arm 64 having a first end 76, a second end 78, and a pivot point 77. First end 76 of rocker arm 64 is operatively engaged with a cam following assembly 52 through a push rod 48. Second end 78 of rocker arm 64 is operatively engaged with intake valve element 68 through a valve stem 70. Rotation of rocker arm 64 about pivot point 77 causes intake valve 65 to move from the first position to the second position.

Valve actuation assembly 36 may also include a valve spring 72. Valve spring 72 may act on valve stem 70 through a locking nut 74. Valve spring 72 may act to move intake valve element 68 relative to cylinder head 28. In the illustrated embodiment, valve spring 72 acts to bias intake valve element 68 into the first position, where intake valve element 68 engages seat 66 to prevent a flow of fluid relative to intake opening 31.

A cam assembly 50 that includes a camshaft 40 may be operatively engaged with crankshaft 51 of engine 20. Cam assembly 50 may be connected with crankshaft 51 in any manner readily apparent to one skilled in the art where a rotation of crankshaft 51 will result in a corresponding rotation of cam assembly 50. For example, cam assembly 50 may be connected to crankshaft 51 through a gear train that reduces the rotational speed of cam assembly 50 to approximately one half of the rotational speed of crankshaft 51.

As shown in FIG. 1, a first intake cam 42 may be disposed on camshaft 40 to rotate with camshaft 40. First intake cam 42 may include a cam lobe 44. As will be explained in greater detail below, the shape of cam lobe 44 on first intake cam 42 will determine, at least in part, the actuation timing of intake valve element 68. One skilled in the art will recognize that first intake cam 42 may include an additional cam lobe and/or the cam lobe 44 may have a different configuration depending upon the desired intake valve actuation timing.

As shown in FIG. 1, a second intake cam 49 may be disposed on camshaft 40 to rotate with camshaft 40. Second intake cam 49 may include a cam lobe 54. As will be explained in greater detail below, the shape of cam lobe 54 on second intake cam 49 will determine, at least in part, the actuation timing of intake valve element 68. One skilled in the art will recognize that second intake cam 49 may include an additional cam lobe and/or the cam lobe 54 may have a different configuration depending upon the desired intake valve actuation timing.

A cam following assembly 52 may be disposed in operative connection between cam assembly 50 and intake valve 65. For example, cam following assembly 52 may be disposed between cam assembly 50 and push rod 48. Alternatively, cam following assembly 52 may be disposed between cam assembly 50 and rocker arm 64 or in any other suitable location.

Cam following assembly 52 includes a cam follower base 60. A first cam lever 61 is pivotally connected to the cam follower base 60 with a clearance between first cam lever 61 and cam follower base 60. Cam lever 61 is adapted to pivot with respect to cam follower base 60 at a pivot point 59 and to engage push rod 48. First cam lever 61 rotably mounts a first cam roller 57. Cam following assembly 52 also includes a second cam lever 62 that is fixed to cam following base 60. Second cam lever 62 rotably mounts a second cam roller 58.

First cam roller 57 of cam following assembly 52 is adapted to engage the surface of cam lobe 44 as first intake cam 42 rotates. The rotation of first intake cam 42 causes first cam lever 61 to pivot about pivot point 59 to thereby produce a reciprocating motion of push rod 48 and a pivoting motion of rocker arm 64 about pivot point 77. Thus, the rotation of first intake cam 42 will cause rotation of rocker arm 64 about pivot point 77 thereby causing intake valve 65 to move from the first position to the second position for a first lift period 92 (referring to FIG. 6).

Second cam roller 58 of cam following assembly 52 is adapted to engage the surface of cam lobe 54 as second intake cam 49 rotates. The rotation of second intake cam 49 causes second cam lever 62 to pivot cam follower base 60 about pivot point 59. Cam follower base 60 pivots through the clearance with first cam lever 61. Thus the rotation of second intake cam 49 may not result in a movement of push rod 48.

Figure 2:
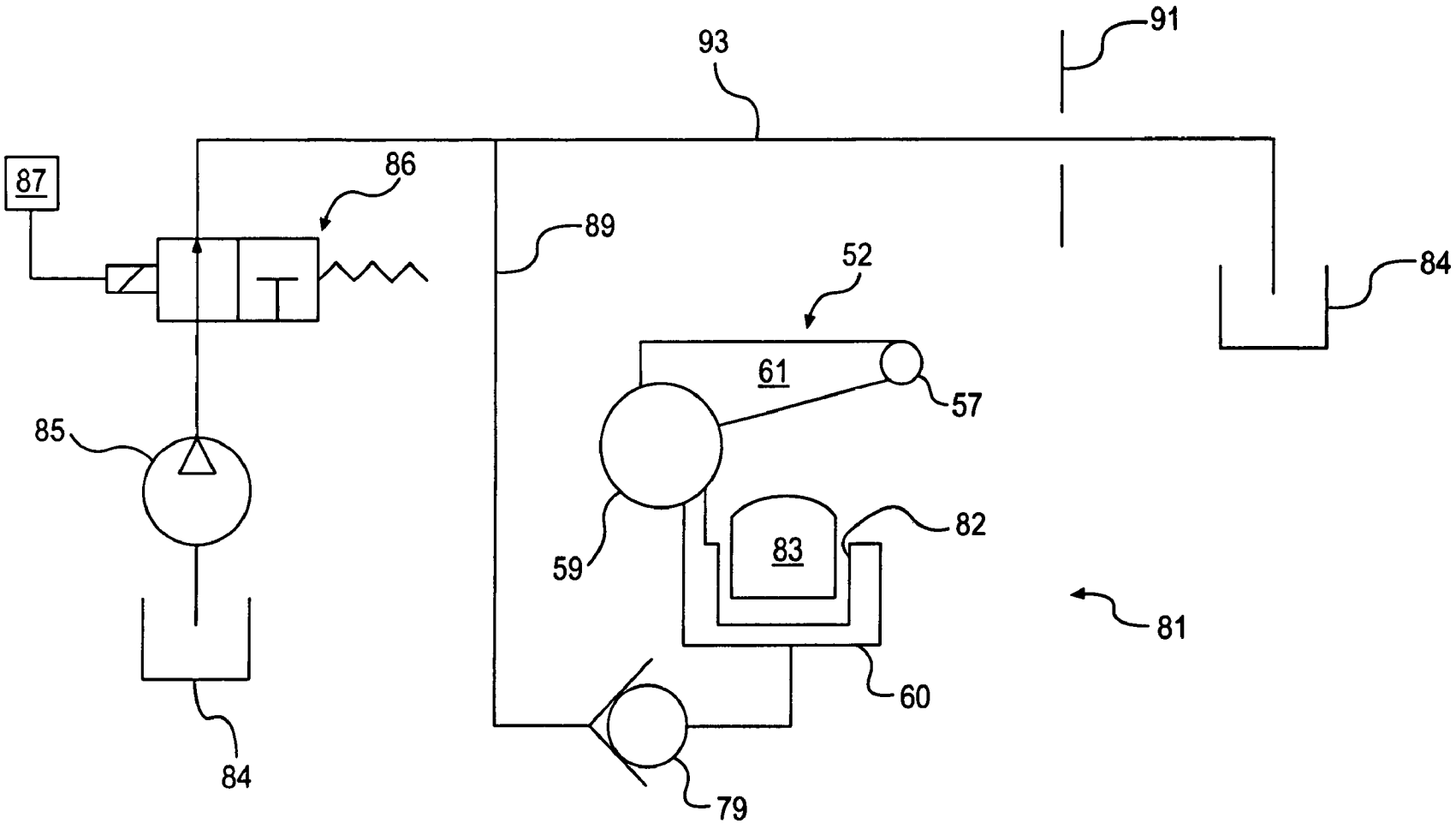
FIG. 2 is a schematic illustration of an engine valve actuation system in accordance with an exemplary embodiment of the present invention.

Cam following assembly 52 may include a locking device 81 manipulated by a controller 87 (referring to FIG. 2). Locking device 81 may be operated to lock cam base 60 and second cam lever 62 to the first cam lever 61 as described in detail below. When second cam lever 62 is locked to first cam lever 61, the pivoting motion of second cam lever 62 is translated to push rod 48 to cause rocker arm 64 to pivot about pivot point 77. Thus, when locking device 81 is actuated, the rotation of second intake cam 49 will cause intake valve 65 to move from the first position to the second position for a second lift period 98 (referring to FIG. 6).

As illustrated in FIGS. 2-5, locking device 81 may be disposed in cam follower base 60. Locking device 81 may include a bore 82 formed in the cam follower base 60 and a piston 83 slidably disposed in the bore 82. Piston 83 may be adapted to extend from bore 82 to engage first cam lever 61.

The locking device 81 may be actuated by a hydraulic system. For example, the hydraulic system may include a reservoir 84 adapted to store a supply of fluid, and a pressurized fluid source 85 in fluid communication with the reservoir 84 and the bore 82 via a fluid passageway 89. A check valve 79 may be disposed in fluid passageway 89 that allows one directional flow of fluid to the bore 82. A restricted orifice 91 may be disposed in a fluid passageway 93 and adapted to increase the pressure in fluid passageways 89, 93. A control valve 86 may be disposed between the bore 82 and the source 85.

The controller 87 may be adapted to move the control valve 86. Controller 87 may include all the components required to run an application such as, for example, a memory, a secondary storage device, and a processor such as a central processing unit. One skilled in the art will appreciate that controller 87 can contain additional or different components. Furthermore, although aspects of the present invention may be described as being stored in memory, one skilled in the art will appreciate that these aspects can also be stored on or read from other types of computer program products or computer-readable media, such as computer chips and secondary storage devices, including hard disks, floppy disks, CD-ROM, or other forms of RAM or ROM. Associated with the controller 87 may be various other known circuits such as, for example, power supply circuitry, signal conditioning circuitry, and solenoid driver circuitry, among others.

Controller 87 may be adapted to move control valve 86 between a first control valve position where fluid is prevented from flowing between the source 85 and the bore 82 and a second control valve position where fluid is allowed to flow between the source 85 and the bore 82. When the control valve 86 is in the first control valve position, the piston 83 is in a first, or retracted, position and the first intake cam 42 controls the movement of the first lever 61 and the associated push rod 48. When the control valve 86 is moved to the second control valve position, the piston 83 is moved to a second, or extended, position to block the clearance between the first cam lever 61 and the cam follower base 60. When the piston 83 is in the second position, first cam lever 61 is prevented from pivoting relative to cam follower base 60 and second cam lever 62. Thus, blocking the clearance between the first cam lever 61 and the cam follower base 60 essentially locks the first cam lever 61 to the cam follower base 60 and second cam lever 62. When the first cam lever 61 is locked to cam follower base 60, control of the motion of the cam following assembly 52 is transferred to the second cam lever 62 following the second intake cam 49 (referring to FIG. 1). When the controller 87 moves control valve 86 back to the first control valve position, the piston 83 is allowed to retract back into bore 82, releasing first cam lever 61 and returning control of the movement of cam following assembly 52 to first intake cam 42.

Figure 3:
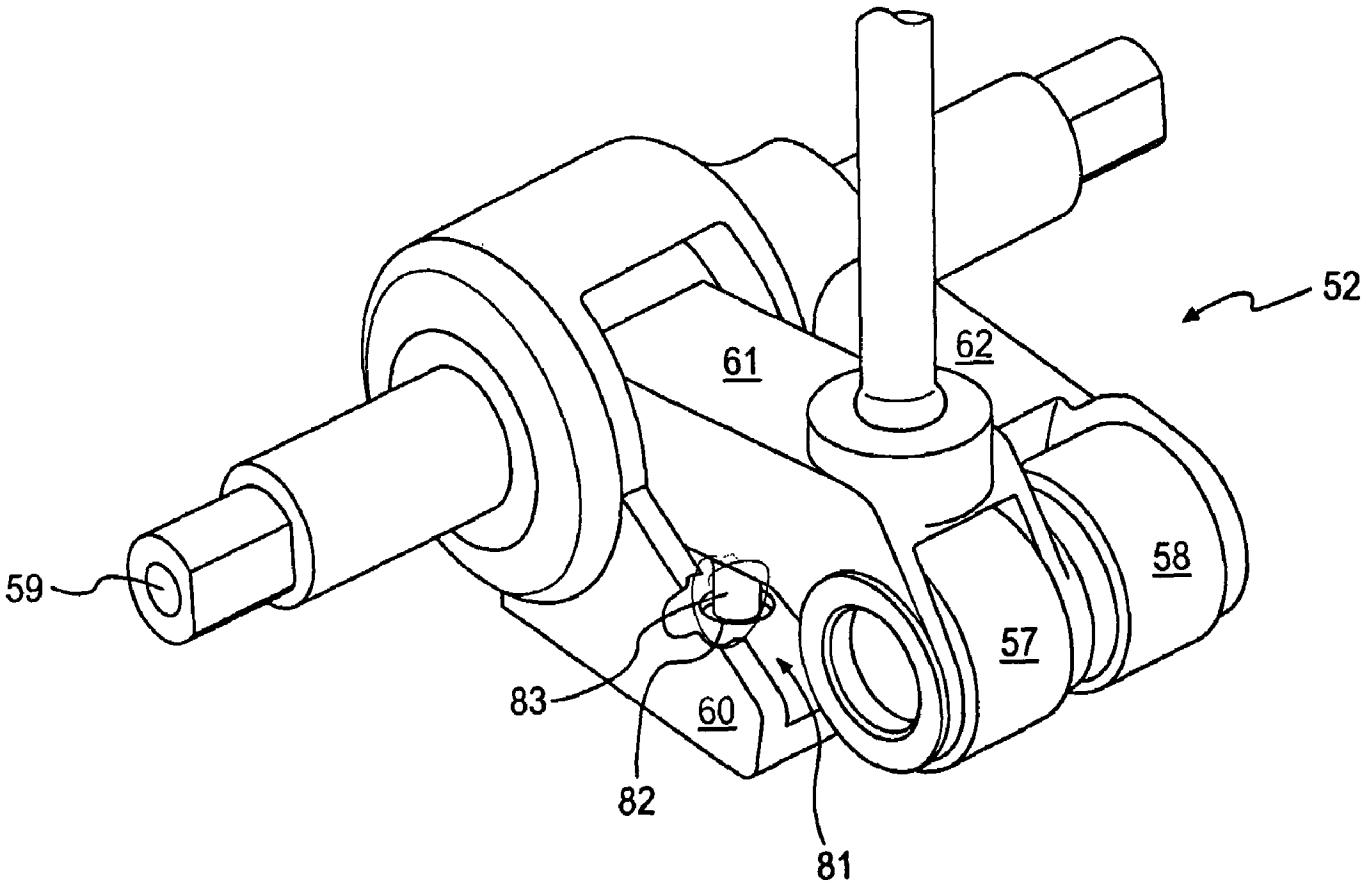
FIG. 3 is a pictorial illustration of a cam following assembly in accordance with an exemplary embodiment of the present invention.

In the exemplary embodiment illustrated in FIG. 3, the locking device 81 allows pressurized fluid to force piston 83 against the first cam lever 61 in the plane of lever motion. The extended piston 83 blocks the pivot clearance between the first cam lever 61 and the cam follower base 60 to essentially lock the movement of first cam lever 61 to the cam follower base 60 and second cam lever 62. The controller 87 may close control valve 86 to stop the flow of pressurized fluid to bore 82. Forces exerted by valve spring 72 (referring to FIG. 1) may act to force the fluid to leak past piston 83 in bore 82. When control valve 86 is in the first control valve position, leakage of the fluid from the bore 82 past the piston 83 to the reservoir 84 may allow piston 83 to return to the retracted position. Fluid leaking past the piston 83 while the control valve 86 is in the second control valve position may be replenished while the first cam roller 57 is on a base circle of the first intake cam 42. The base circle is the portion of the cam opposite the cam lobe.

Figure 4:
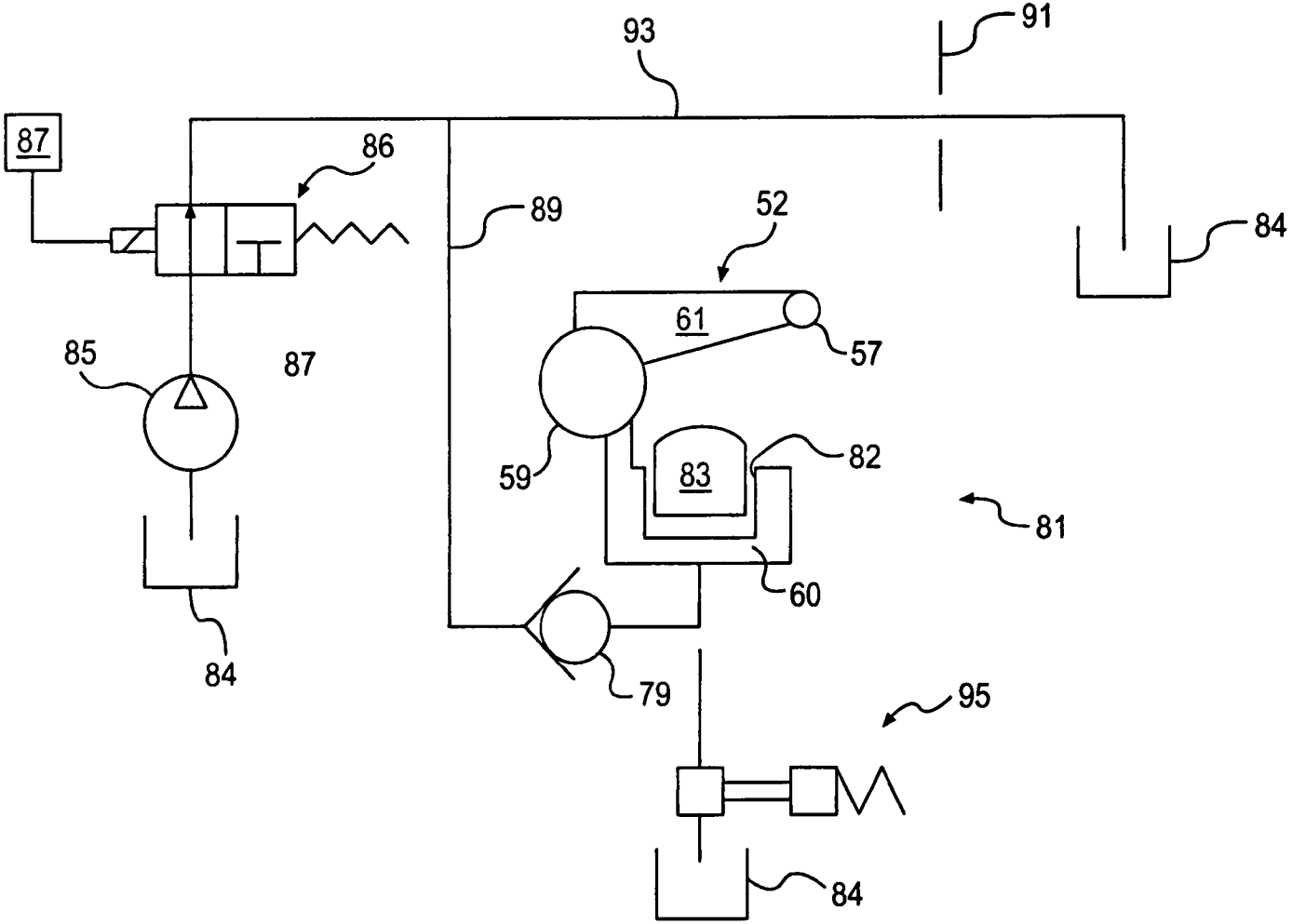
FIG. 4 is a schematic illustration of an engine valve actuation system in accordance with an exemplary embodiment of the present invention.

Alternatively, as shown in FIG. 4, a bleed valve assembly 95 may be included in locking device 81 and actuated when the control valve 86 is moved to the first control valve position providing a path for the fluid to flow from the piston 83 to the reservoir 84, thereby allowing piston 83 to return to the retracted position.

Figure 5:
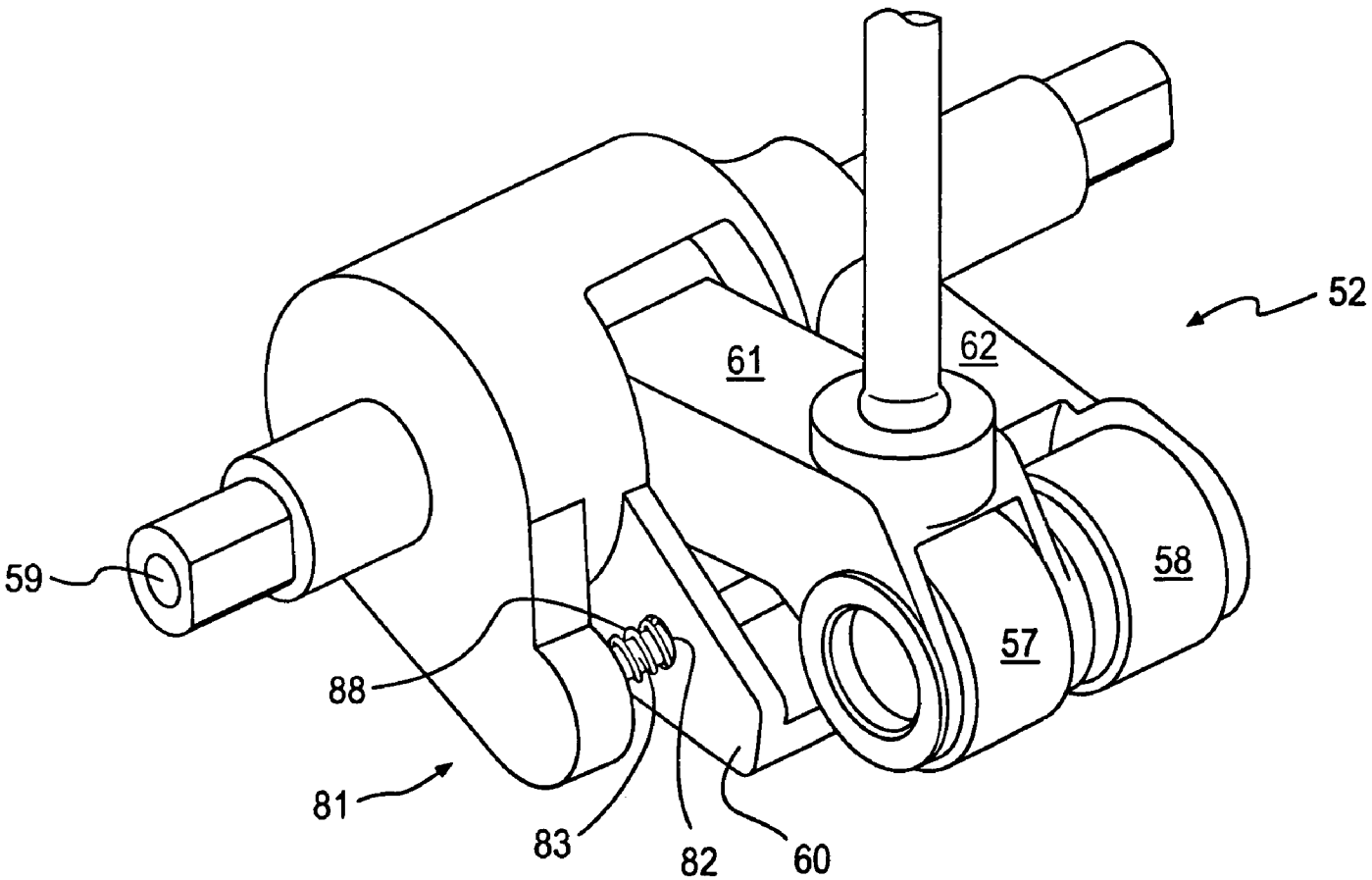
FIG. 5 is a pictorial illustration of a cam following assembly in accordance with an exemplary embodiment of the present invention.

In the embodiment of FIG. 5, the locking device 81 allows pressurized fluid to force piston 83 to extend in a sideways perpendicular motion relative to the movement of first cam lever 61. The piston 83 may be extended when the first cam roller 57 is on a radius end of the cam lobe 44 or when first cam lever 61 is in the furthest extended position relative to the cam follower base 60. When the piston 83 is fully extended, the piston 83 engages the first cam lever 61 and prevents the first cam lever 61 from pivoting towards the cam follower base 60. The sideways extension of piston 83 essentially locks first cam lever 61 to cam follower base 60 and second cam lever 62. When first cam lever 61 is locked to cam follower base 60 and second cam lever 62, the associated first cam roller 57 is removed from following the profile of first intake cam 42.

Controller 87 may close control valve 86 to stop the flow of pressurized fluid to bore 82. Forces exerted by a return spring 88 may act to force the fluid to leak past piston 83 in bore 82 to the reservoir 84. When control valve 86 is in the first control valve position, leakage of the fluid may allow piston 83 to return to the retracted position. Fluid that has leaked past the piston 83 while the control valve 86 is in the second control valve position may be replenished continually. Similar to the embodiment described above, the alternative bleed valve assembly 95 of FIG. 4 may also be incorporated with the embodiment of FIG. 5.

Locking device 81 is operable to selectively allow the first and second intake cams 42, 49 to control the movement of the cam following assembly 52, thereby adjusting the actuation timing of the intake valve 65. For example, the first intake cam 42 may control the movement of the cam following assembly 52 during engine starting, operating under cold conditions, or when experiencing a transient condition. The second intake cam 49 may control the movement of the cam following assembly 52 during steady state operation.

Figure 6:
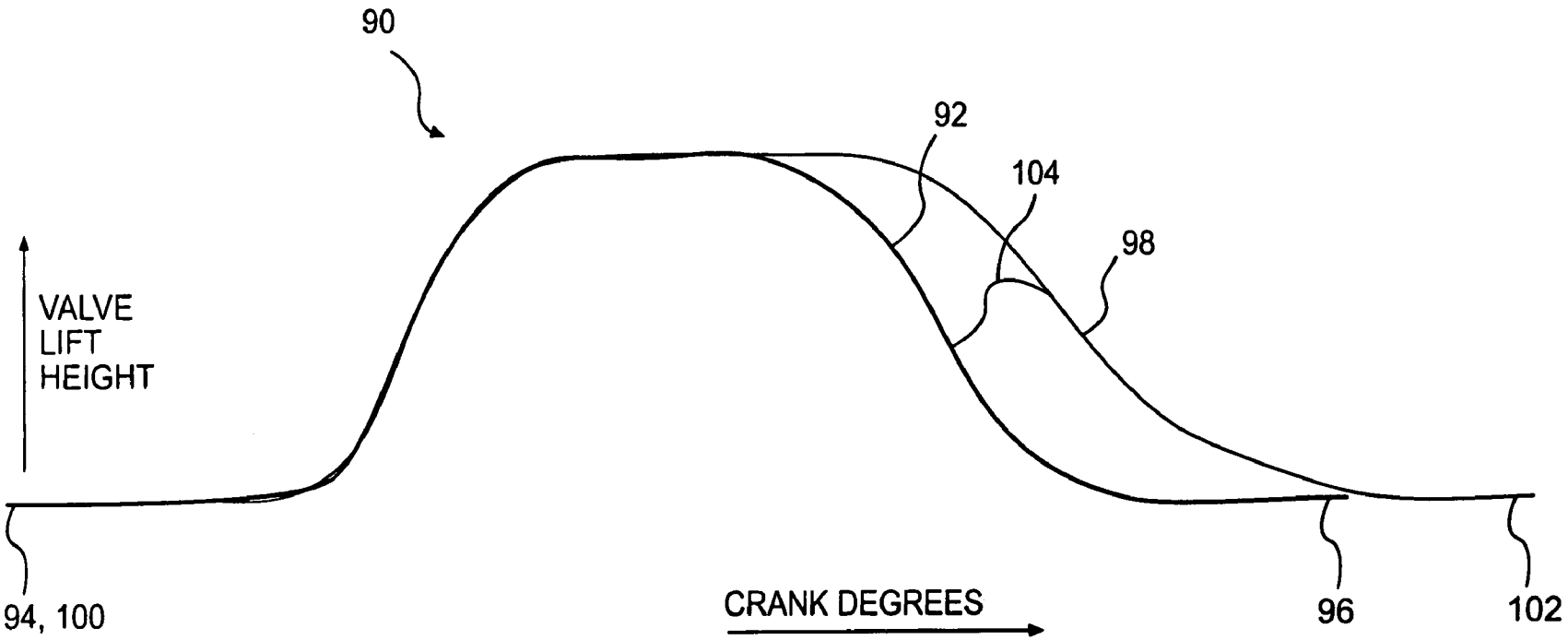
FIG. 6 is a graph illustrating exemplary valve actuation periods for an engine valve actuation system in accordance with the present invention.

For example, FIG. 6 illustrates a graph 90 depicting a first lift period 92 such as may be initiated by first intake cam 42 and a second lift period 98 such as may be initiated by second intake cam 49. First lift period 92 includes a start 94 and an end 96. Second lift period 98 includes a start 100 and an end 102.

It should be noted that the control over the actuation timing of the intake valve 65 may be transferred from one cam to the other. Second intake cam 49 may be adapted to retard the closing movement of intake valve 65 relative to the first lift period 92. In other words, first intake cam 42 may have already lifted intake valve 65 from the first position before cam lobe 54 of second intake cam 49 rotates to engage cam following assembly 52. In this situation, second intake cam 49 may not control the movement of intake valve 65 until the valve begins to seat as first intake cam 42 may have already caused rocker arm 64 to lift intake valve 65. Under certain circumstances, cam following assembly 52 may be adjusted so that second intake cam 49 does not alter the movement of intake valve 65. Likewise, under certain circumstances, first intake cam 42 may be locked to cam follower base 60 so that first intake cam 42 does not alter the movement of intake valve 65.

In an exemplary valve actuation, first and second lift periods 92 and 98 will overlap. When the first and second lift periods 92 and 98 overlap, the lifting of intake valve 65 may be controlled entirely by second intake cam 49. Alternatively, the opening of intake valve 65 may be controlled by first intake cam 42 for the start 94 of the first lift period. The locking device 81 may lock first cam lever 61 to cam follower base 60 after intake valve 65 has started to close so that the closing of intake valve 65 may be completed by second intake cam 49 by the end 102 of the second lift period. In this situation, control of the motion of the cam following assembly 52 and the associated intake valve 65 is handed off from first intake cam 42 to second intake cam 49 at transfer point 104.

An impact-absorbing device (not shown) may be used to decrease the impact on cam following assembly 52 when first intake cam 42 and second intake cam 49 engage cam following assembly 52. For example, the impact-absorbing device may be a cam that acts to decelerate the first cam lever 61 just prior to the transfer of the motion of cam following assembly 52 from second intake cam 49 to first intake cam 42. Alternatively, impact absorbing device (not shown) may include a travel limited hydraulic lifter or a spring/damper combination.

In addition, an adjustment device (not shown) may be operatively associated with cam following assembly 52 and/or the impact-absorbing device. The adjustment device may be adapted to adjust the position of cam following assembly 52 relative to camshaft 40 and the associated first and second intake cams 42, 49. The adjustment device may be used to compensate for manufacturing tolerances and/or changes in the size of components due to temperature changes. The adjustment device may include any means for changing the position of cam following assembly 52 relative to first intake cam 42 and second intake cam 49. For example, the adjustment device may include threads, nuts, springs, detents, or any other similar position adjusting mechanism.

INDUSTRIAL APPLICABILITY

The operation of engine 20 will cause a rotation of crankshaft 51, which will cause corresponding rotation of camshaft 40. The rotation of camshaft 40 also rotates first intake cam 42 and second intake cam 49. When piston 83 of locking device 81 is in the retracted position, the motion of first cam lever 61 will move push rod 48 to pivot rocker arm 64 to start first lift period 92 (referring to FIG. 6) of intake valve 65. First lift period 92 may be coordinated with the start of movement of piston 26. For example, start 94 of first lift period 92 may coincide with the movement of piston 26 from a top-dead-center position towards a bottom-dead-center position in an intake stroke. The movement of intake valve 65 from the first position to the second position allows a flow of fluid to enter combustion chamber 24.

As first intake cam 42 and cam lobe 44 continue to rotate, valve spring 72 will act to return intake valve 65 to the first position and end first lift period 92. End 96 of first lift period 92 may, for example, be timed to coincide with the movement of piston 26 to the bottom-dead-center position at the end of the intake stroke. The return of intake valve 65 to the first position prevents-additional fluid from flowing into combustion chamber 24.

Controller 87 may be operated to move a control valve 86 from a first control valve position to a second control valve position where fluid pressure causes a piston 83 to move from the retracted position to the extended position. In the extended position, first cam lever 61 is locked to cam follower base 60 and control of the motion of the intake valve 65 is transferred from the first intake cam 42 to the second intake cam 49. When the control valve 86 is moved back to the first control valve position, the piston 83 is allowed to retract back into bore 82, releasing first cam lever 61 and returning control of the movement of the intake valve 65 to first intake cam 42.

Thus, controller 87 may be operated to selectively transfer control of the movement of intake valve 65 between the first and second intake cams 42, 49. The first intake cam 42 may control the movement of the engine valve during engine starting, operating under cold conditions, or when experiencing a transient condition. The second intake cam 49 may control the movement of the engine valve during steady state operation. Locking device 81 may be operated to delay the return of intake valve 65 to the first position. Cam lobe 54 of second intake cam 49 is in a position to delay the valve closing rotation of cam following assembly 52 to a later time, relative to the motion of first intake cam 42.

Second intake cam 49 may operate to control movement of intake valve 65 independent of first intake cam 42 in a second lift period 98 or in conjunction with first intake cam 42 in a variable lift period. Operating in conjunction with first intake cam 42 may result in second intake cam 49 assuming control of cam following assembly 52 at transfer point 104 (referring to FIG. 6). When operating either independently or in conjunction with first intake cam 42, cam lobe 54, of second intake cam 49, will prevent intake valve 65 from returning to the first position until end 102 of second lift period 98. End 102 of delayed second lift period 98 may be timed to coincide with a certain movement of piston 26. For example, second lift period 98 may be timed to end after piston 26 moves through a first portion of a compression stroke such as in a "late-intake" type Miller cycle.

As will be apparent from the foregoing description, the disclosed system and method provide for the varying of the actuation of an engine valve of an engine 20. By shifting the control of the engine valve from a first intake cam 42 to a second intake cam 49, the actuation timing of the engine valve, such as an intake valve 65 or an exhaust valve, may be adjusted. The second intake cam 49 may control the intake valve 65 to implement a variation on a conventional valve timing such as, for example, a late-intake type Miller cycle.

It will be apparent to those skilled in the art that various modifications and variations can be made in the engine valve actuation system of the present disclosure without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A valve actuation system, comprising:

an engine valve moveable between a first position at which the engine valve prevents a flow of fluid relative to the engine valve and a second position at which the fluid flows relative to the engine valve;

a first cam adapted to move the engine valve from the first position to the second position during a first lift period in response to a rotation of the first cam;

a second cam adapted to move the engine valve from the first position to the second position during a second lift period in response to a rotation of the second cam;

wherein the first cam and the second cam are adapted to move the engine valve to the same second position;

a cam following assembly disposed between the first and second cams and the engine valve, the cam following assembly adapted to selectively connect one of the first and second cams with the engine valve to thereby move the engine valve through one of the first and second lift periods, wherein the cam following assembly includes:

a first cam roller selectively engagable with the first cam;

a second cam roller selectively engagable with the second cam;

a cam follower base;

a first cam lever pivotally connecting the first cam roller to the cam follower base; and a second cam lever fixably connecting the second cam roller to the cam follower base;

a bore disposed in the cam follower base;

a piston slidably disposed in the bore, the piston adapted to move between a first piston position at which the piston is retracted relative to the cam follower base and the first cam controls the movement of the cam following assembly to move the engine valve through the first lift period, and a second piston position at which the piston extends from the bore to engage the first cam lever to cause the second cam to control the movement of the cam following assembly thereby executing the second lift period;

a reservoir adapted to store a supply of fluid;

a source in fluid communication with the reservoir and the bore via a fluid passageway; and a control valve disposed between the bore and the source, the control valve movable between a first control valve position at which fluid is prevented from flowing between the source and the bore and a second control valve position at which fluid flows between the source and the bore causing the piston to move from the first piston position to the second piston position.

2. The valve actuation system of claim 1, further including a controller configured to move the control valve between the first control valve position and the second control valve position.

3. The valve actuation system of claim 1, further including a return spring adapted to bias the piston towards the first piston position.

4. The valve actuation system of claim 1, further including a bleed valve disposed in a fluid passageway between the bore of the cam follower base and the supply.

5. The valve actuation system of claim 1, further including a restrictive orifice disposed between the source and the supply.

6. The valve actuation system of claim 1, wherein the piston moves in a direction perpendicular to the first cam lever motion to block the first cam lever in an extended position.

7. The valve actuation system of claim 1, further including a rocker arm operatively connected with the engine valve and a push rod operatively connected between the cam following assembly and the rocker arm.

8. The valve actuation system of claim 1, wherein the valve actuation system is configured so that the first and second cams operate to control movement of the engine valve independent of one another.

9. A method of actuating an engine valve having a first position at which the engine valve prevents a flow of fluid relative to the engine valve and a second position at which the fluid flows relative to the engine valve, comprising:

rotating a first cam having an outer surface adapted to move the engine valve from the first position to the second position during a first lift period;

rotating a second cam having an outer surface adapted to move the engine valve from the first position to the second position during a second lift period;

wherein the first cam and the second cam are adapted to move the engine valve to the same second position; and operating a cam following assembly to selectively connect one of the first and second cams with the engine valve and moving the engine valve through one of the first and second lift periods, wherein operating the cam following assembly includes:

directing a pressurized fluid to a bore in the cam following assembly to move a piston into engagement with a first cam lever to connect the second cam with the engine valve; and releasing the pressurized fluid from the bore to connect the first cam with the engine valve.

10. The method of claim 9, further including allowing the pressurized fluid to leak past the piston in the bore to allow the piston to retract into the bore.

11. The method of claim 9, further including opening a bleed valve to allow the piston to retract into the bore.

12. The method of claim 9, wherein the first and second cams operate to control movement of the engine valve independent of one another.

13. A valve actuation system, comprising:

an engine valve moveable between a first position at which the engine valve prevents a flow of fluid relative to the engine valve and a second position at which the fluid flows relative to the engine valve;

a first cam adapted to move the engine valve from the first position to the second position during a first lift period in response to a rotation of the first cam;

a second cam adapted to move the engine valve from the first position to the second position during a second lift period in response to a rotation of the second cam;

wherein the first cam and the second cam are adapted to move the engine valve to the same second position;

a cam following means for selectively connecting one of the first and second cams with the engine valve to thereby move the engine valve through one of the first and second lift periods, wherein the cam following assembly includes:

a first cam roller selectively engagable with the first cam;

a second cam roller selectively engagable with the second cam;

a cam follower base;

a first cam lever pivotally connecting the first cam roller to the cam follower base; and a second cam lever fixably connecting the second cam roller to the cam follower base;

a bore disposed in the cam follower base;

a piston slidably disposed in the bore, the piston adapted to move between a first piston position at which the piston is retracted relative to the cam follower base and the first cam controls the movement of the cam following assembly to move the engine valve through the first lift period, and a second piston position at which the piston extends from the bore to engage the first cam lever to cause the second cam to control the movement of the cam following assembly thereby executing the second lift period;

a reservoir adapted to store a supply of fluid;

a source in fluid communication with the reservoir and the bore via a fluid passageway; and a control valve disposed between the bore and the source, the control valve movable between a first control valve position at which fluid is prevented from flowing between the source and the bore and a second control valve position at which fluid flows between the source and the bore causing the piston to move from the first piston position to the second piston position.

14. The valve actuation system of claim 13, wherein the valve actuation system is configured so that the first and second cams operate to control movement of the engine valve independent of one another.

15. An engine, comprising:

a block defining a combustion chamber;

a crankshaft;

a valve actuation system including:

an engine valve operatively associated with the combustion chamber and moveable between a first position at which the engine valve prevents a flow of fluid relative to the combustion chamber and a second position at which the fluid flows relative to the combustion chamber;

a first cam adapted to move the engine valve from the first position to the second position during a first lift period in response to a rotation of the crankshaft;

a second cam adapted to move the engine valve from the first position to the second position during a second lift period in response to a rotation of the second cam;

wherein the first cam and the second cam are adapted to move the engine valve to the same second position; and a cam following assembly disposed between the first and second cams and the engine valve, the cam following assembly adapted to selectively connect one of the first and second cams with the engine valve to thereby move the engine valve through one of the first and second lift periods, wherein the cam following assembly includes:

a first cam roller selectively engagable with the first cam;

a second cam roller selectively engagable with the second cam;

a cam follower base;

a first cam lever pivotally connecting the first cam roller to the cam follower base; and a second cam lever fixably connecting the second cam roller to the cam follower base;

a bore disposed in the cam follower base;

a piston slidably disposed in the bore, the piston adapted to move between a first piston position at which the piston is retracted relative to the cam follower base and the first cam controls the movement of the cam following assembly to move the engine valve through the first lift period, and a second piston position at which the piston extends from the bore to engage the first cam lever to cause the second cam to control the movement of the cam following assembly thereby executing the second lift period;

a reservoir adapted to store a supply of fluid;

a source in fluid communication with the reservoir and the bore via a fluid passageway; and a control valve disposed between the bore and the source, the control valve movable between a first control valve position at which fluid is prevented from flowing between the source and the bore and a second control valve position at which fluid flows between the source and the bore causing the piston to move from the first piston position to the second piston position.

16. The engine of claim 15, wherein the valve actuation system further includes a controller configured to move the control valve between the first control valve position and the second control valve position.

17. The engine of claim 15, wherein the valve actuation system further includes a return spring adapted to bias the piston towards the first position.

18. The engine of claim 15, wherein the valve actuation system further includes a bleed valve disposed in a fluid passageway between the bore of the cam follower base and the supply.

19. The engine of claim 15, wherein the valve actuation system further includes a restrictive orifice disposed between the source and the supply.

20. The engine of claim 15, wherein the piston moves in a direction perpendicular to the first cam lever motion to block the first cam lever in the extended position.

21. The engine of claim 15, further including a rocker arm operatively connected with the engine valve and a push rod operatively disposed between the first lever of the cam following assembly and the rocker arm.

22. The engine of claim 15, wherein the engine is configured so that the first and second cams operate to control movement of the engine valve independent of one another.

* * * * *